US006382878B1

(12) United States Patent
Yang

(10) Patent No.: US 6,382,878 B1
(45) Date of Patent: May 7, 2002

(54) MULTI-SECTIONED CONCRETE SUPPORT STRUCTURE AND METHOD OF MANUFACTURE

(76) Inventor: Yue-Chyou Yang, 315 Bay St., 3rd Floor, San Francisco, CA (US) 94133

( * ) Notice: Subject to any disclaimer, the term of this patent is extended or adjusted under 35 U.S.C. 154(b) by 0 days.

(21) Appl. No.: 09/544,003

(22) Filed: Apr. 6, 2000

Related U.S. Application Data

(63) Continuation-in-part of application No. 09/454,694, filed on Dec. 3, 1999.

(51) Int. Cl.[7] ..... B22C 9/00; B41D 3/08; B41D 3/10; E02D 5/30; E02D 5/34; E02D 5/48; E04I 3/34

(52) U.S. Cl. ..... 405/232; 405/233; 405/250; 405/256; 405/257; 249/48; 249/144; 52/721.2; 52/736.1; 52/736.3; 52/738.1

(58) Field of Search ..... 405/222, 223, 405/224, 231–233, 239, 244, 245, 250–252, 256, 257; 249/48, 110, 160, 63, 144, 175; 52/720.1, 721.1, 721.2, 726.1, 726.3, 736.1, 736.3, 738.1

(56) References Cited

U.S. PATENT DOCUMENTS

| | | | | |
|---|---|---|---|---|
| 1,762,341 A | | 6/1930 | McPherson | |
| 3,638,433 A | * | 2/1972 | Sherard | 405/50 |
| 4,117,639 A | * | 10/1978 | Steenson et al. | 52/223.6 |
| 4,327,703 A | | 5/1982 | Destree | 125/1 |
| 4,604,003 A | | 8/1986 | Francoeur et al. | 405/256 |
| 4,631,892 A | * | 12/1986 | Beck | 52/721.3 |
| 4,696,605 A | * | 9/1987 | Gillen, Jr. | 405/251 |
| 4,829,733 A | * | 5/1989 | Long | 52/309.11 |
| 5,593,251 A | * | 1/1997 | Gillen | 405/250 |
| 5,797,238 A | * | 8/1998 | Berntsson et al. | 52/612 |
| 5,909,984 A | | 6/1999 | Matthews | 405/257 |
| 6,189,286 B1 | * | 2/2001 | Seible et al. | 52/721.4 |

OTHER PUBLICATIONS

Mark Fintel, Handbook of Concrete Engineering, 1985, Van Nostrand Reinhold Company, Second Edition, pp. 297–298.*

* cited by examiner

*Primary Examiner*—Thomas B. Will
*Assistant Examiner*—Tara L. Mayo
(74) *Attorney, Agent, or Firm*—Heller Ehrman White & McAuliffe

(57) ABSTRACT

An economical, high strength, highly corrosion-resistant, multi-section concrete support structure includes a first concrete section attached to a second concrete section. The first concrete section consists of a first concrete type and the second concrete section consists of a diverse, second concrete type.

20 Claims, 9 Drawing Sheets

MULTI-SECTIONED CONCRETE SUPPORT STRUCTURE AND METHOD OF MANUFACTURE

CROSS REFERENCE TO RELATED APPLICATIONS

This is a continuation in part or application Ser. No. 09/454,694 filed Dec. 3, 1999, entitled "Multi-sectioned Concrete Support Structure and Method of Manufacture," the contents of which are herein incorporated by reference in its entirety for all purposes.

BACKGROUND OF THE INVENTION

The present invention relates to concrete support structures and in particular relates to multi-sectioned concrete support structures exhibiting high strength and corrosion resistance.

Concrete is widely used as a medium to form support structures in a number of different applications. For instance, foundations, support pilings, beams, and containers are just a few examples of concrete support structures which have been used in a variety of construction applications, ranging from bridge erection to nuclear power plant construction.

In its conventional form, concrete consists of aggregate, cement, and sand, and weighs approximately 4,040 lbs. per cubic yard. The aggregate portion provides the majority of the strength and weight to the concrete structure. Cement provides adhesion between the components and also fills in the voids between the aggregate compound particles. Sand is used to fill in the voids left between cement particles.

While conventional concrete structures provide good load bearing capability, they are prone to corrosion. For instance, pilings made from standard concrete do not possess a high degree of water impermeability. When concrete pilings are used in aquatic environments such as in or near fresh or salt water, the exposed concrete corrodes, thereby shortening the lifetime of the section and entire support structure. Other corrosive environments, such as chemical pools, also present the same obstacle.

Several techniques have been developed to protect concrete support structures from corrosive elements. For instance in the area of submerged concrete support structures, a protective steel jacket is placed around the concrete piling to provide a water-impermeable barrier between the water and the piling. However, the exposed steel jacket itself is prone to corrosion and requires cathodic protection. The total cost of the steel-jacketed concrete piling is very high due to the high materials cost of the steel jacket and the operating expense of providing cathodic protection.

Another technique which has been used to enhance the corrosion resistance of concrete support structures is the use of silica-mixed concrete. Silica-mixed concrete is standard concrete (described above) with a microsilica additive. The microsilica fills in the small gaps between cement particles, thereby imparting a high degree of impermeability to water, chemicals, solvents, or other concrete-corrosive materials. The resulting structure exhibits a higher resistance to corrosion than similar concrete structures without the microsilica additive.

Unfortunately, silica-mixed concrete is substantially more expensive than standard grade concrete, typically adding 75% to the cost of materials. As a consequence, silica-mixed concrete support structures have not been widely used in large-scale construction projects.

What is needed is a more economical concrete structure which exhibits high strength and corrosion resistance.

SUMMARY OF THE INVENTION

The present invention describes an economical, high strength, highly corrosion-resistant, multi-section concrete support structure and method of manufacture. In one embodiment of the invention, a multi-sectioned concrete support structure is presented and includes a first concrete section attached to a second concrete section. The first concrete section consists of a first concrete type and the second concrete section is above the first one, consists of a diverse, second concrete type. The diversity of concrete types in the support structure can be used to provide greater structural strength, increased resistance to concrete corrosion, decreased member weight, and lower cost compared to conventional homogeneous concrete support structures.

DESCRIPTION OF SPECIFIC EMBODIMENTS

Figure 1:
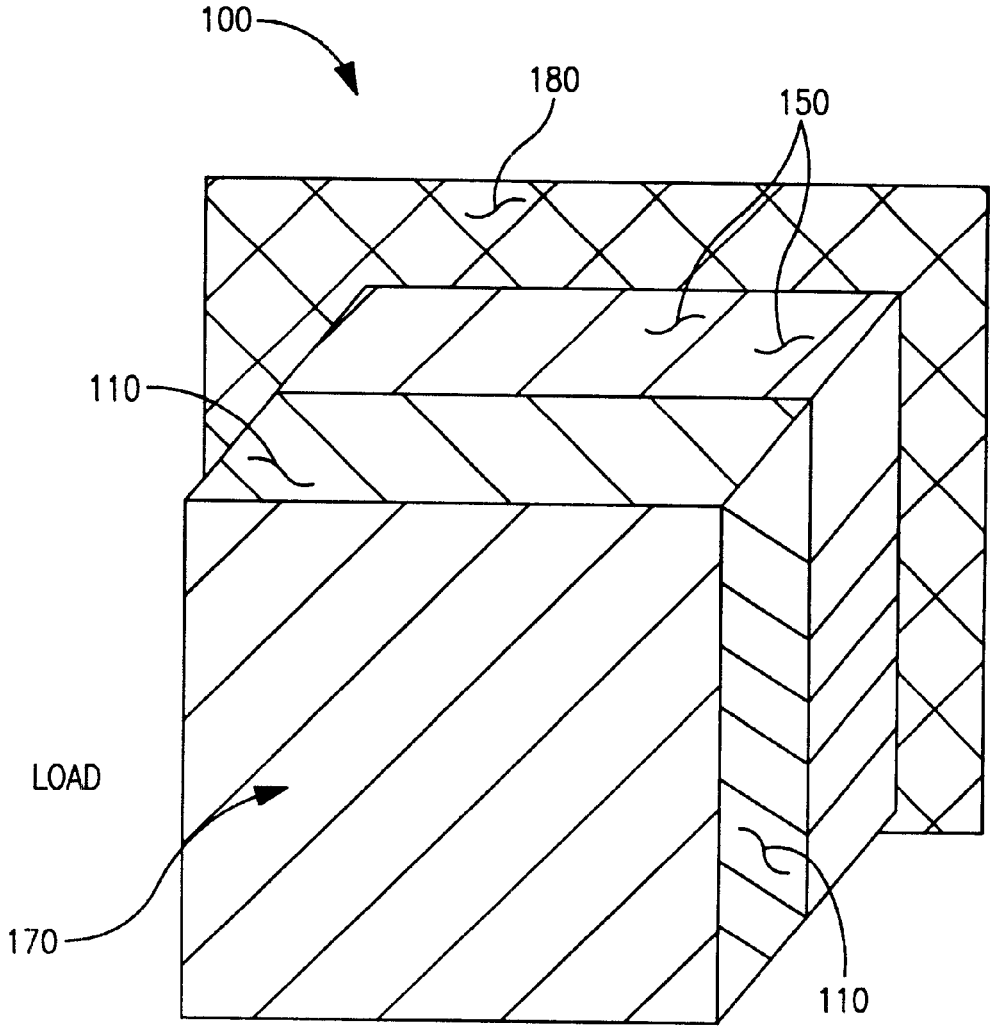
FIG. 1 illustrates a multi-sectioned concrete support structure in accordance with one embodiment of the present invention.

FIG. 1 illustrates a multi-sectioned concrete support structure 100 in accordance with one embodiment of the present invention. The structure 100 includes a first concrete section 110 attached to a second concrete section 150 for providing support to a load which is generally applied in the direction illustrated by a central load line 170. In the illustrated embodiment, the load is applied to the first concrete section 110 and the second concrete section 150 is securely attached to a load bearing surface 180, although in an alternative embodiment, the orientation of the first and second concrete sections may be reversed. Central load line 170 shows the general direction of the applied load and does not necessarily represent a specific loading point. For instance, loading may be applied around the periphery of the first concrete section 110.

Attachment between first and second concrete section 110 and 150 may be made using any conventional means, such as through the use of concrete, reinforcing members, bolts, or other concrete to concrete attachment techniques. While the illustrated embodiment shows two attached concrete sections, N additional sections may be added to either the first or section concrete sections in an alternative embodiment. First and second concrete sections 110 and 150 may assume square, rectangular, cylindrical, elliptical, circular, or other shapes as desired.

First concrete section 110 is formed from a first concrete-type, and the second concrete section 150 is formed from a second, dissimilar concrete-type. For instance, the first concrete type may be standard grade concrete, and the second concrete type may be silica-mixed concrete, both of which are available from the RMC Company of Decatur, Ga. as well as other concrete manufacturers.

Figure 2:
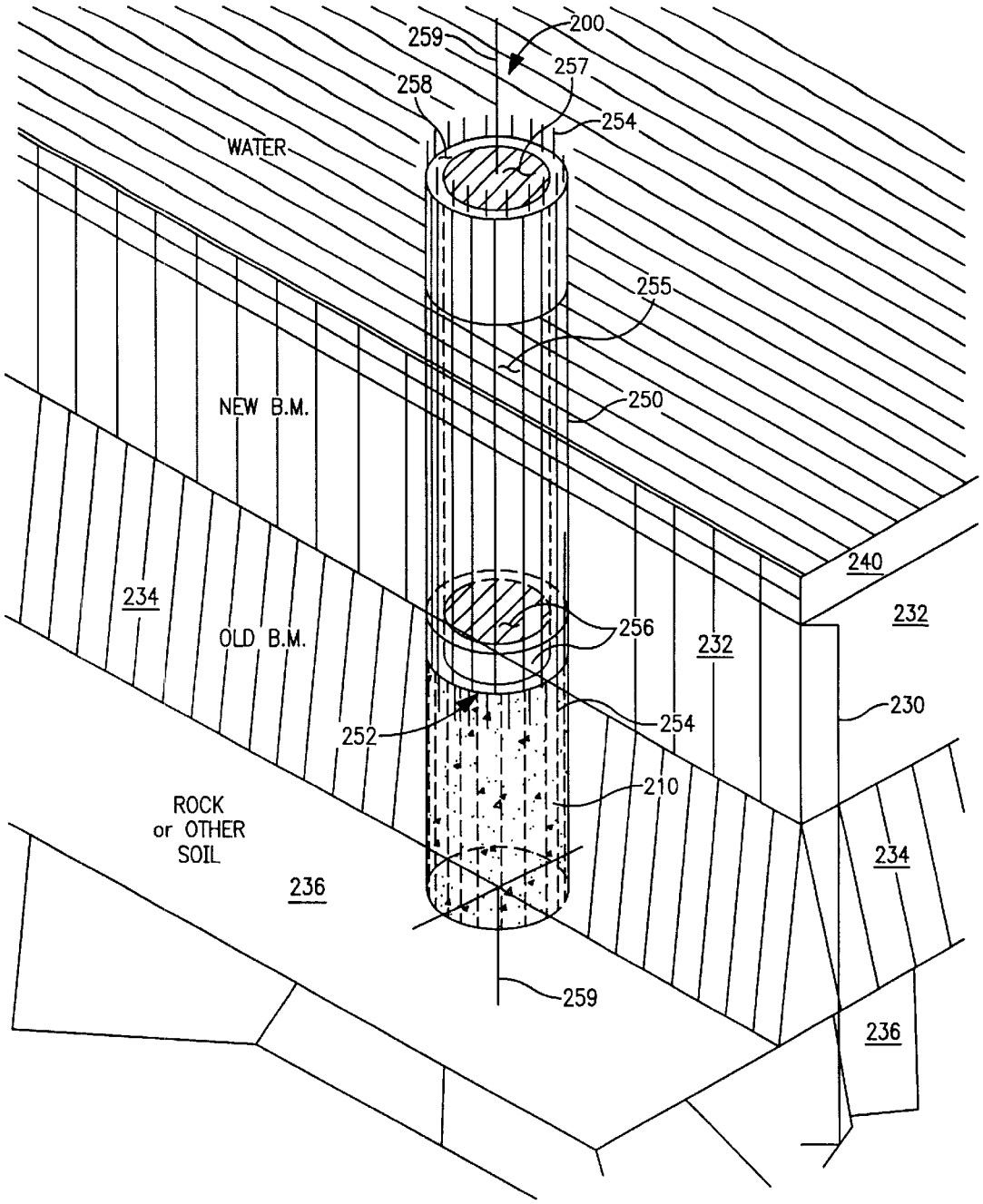
FIG. 2 illustrates a multi-sectioned concrete piling 200 in accordance with a second embodiment of the present invention.

As one possible embodiment of the present invention, FIG. 2 illustrates a multi-sectioned concrete piling 200 for use in a concrete corrosive environment such as a body of fresh or salt water 240. In an alternative embodiment, part of the multi-sectioned concrete piling may be located in a chemical pool or other concrete corrosive environments. As will be further described below, the multi-sectioned concrete piling 200 enables the usage of concrete support structures in highly corrosive environments. Of course, the multi-sectioned concrete piling 200 may be employed in non-corrosive environments as well.

Beneath the water floor, multi-sectioned concrete piling 200 is embedded on a load bearing surface consisting of a seabed 230. As illustrated, the seabed 230 is composed of a new bay mud layer 232, an old bay mud layer 234, and a bedrock layer 236. The new bay mud layer 232 may include of loose sediment and soil and exhibits a relatively low resistance to flow. The old bay mud 234 may include condensed soil and exhibits a relatively high resistance to flow. The bedrock layer 236 may include soil, sedimentary rock, as well as permanent rock formations. The bedrock layer 236 exhibits an extremely high resistance to flow. The depths of the new and old bay mud layers 232 and 234 will vary depending upon the location of the site. As an example, within the San Francisco bay, the new bay mud layer may extend between 20 to 60 feet and the old bay mud layer may extend between 30 to 200 feet. In other environments in which new bay mud, old bay mud, and seabed layers are not present, concrete piling 260 is attached or secured to a submerged layer having a high resistance to flow.

The first concrete section 210 is formed below the old bay mud layer 234, the method of which is further described below. The depth to which the first concrete section 210 extends into the old bay mud layer 232 is a design choice influenced by the diameter and load of the piling, the desired load capacity, the type of concrete used, the depth and flow resistance of the old bay mud, as well as other factors appreciable to those skilled in the art. The first concrete section may extend only partially into the old bay mud layer 234, through the old bay mud layer 234, or into the bedrock layer 236. In one embodiment, first concrete section 210 is constructed from standard grade concrete having a 6-foot to 10-foot diameter and extending from 5 to 100 feet below the new bay mud layer 232. In an alternative embodiment, first concrete section 210 is constructed from a lower weight concrete for weight savings. Those of skill in the art will appreciate that other concrete types and piling dimensions may be used.

The second concrete section 250 in one embodiment is a pre-cast, tubular and cylindrically-shaped silica-mixed concrete section having an internal cavity 255 extending along the center load line 259 and reinforcing members 254 extending from the bottom and top surfaces 252 and 258. Reinforcing members are integrally formed within and distributed near the periphery of the second concrete section 260.

Variations on the above described second concrete section 250 are of course possible. For example in one alternative embodiment, the second concrete section 250 is not pre-cast, but instead poured into place. In still a further alternative embodiment in which the second concrete section 250 is a tubular and cylindrically-shaped silica-mixed concrete section, a different concrete type, perhaps standard grade concrete is used to partially or completely fill the internal cavity 255. Those of skill in the art will appreciate that the aforementioned variations represent only a few of the possible embodiments and that additional embodiments based upon the foregoing description are possible and within the scope of the present invention.

Attachment between the first and second concrete sections 210 and 250 may be achieved through a variety of techniques. In one embodiment, attachment is made by immersing, at least partially, reinforcing members 254 into the newly poured first concrete section 210 before the first concrete section 210 hardens, as will be described in further detail below.

The interface between the first and second concrete sections 210 and 250 is positioned below the new bay mud layer 232 such that the first concrete section 210 is substantially insulated from water, chemicals, or other corrosive elements. The second concrete section 250 is exposed to the bay water 240 or other present corrosive elements, extending from the old bay mud layer 234 to a predefined height above the water surface.

In one embodiment, the second concrete section 250 is a formed from silica-mixed concrete. As explained above, the microsilica particles fills in the small voids normally left in standard concrete, thereby imparting a high degree of impermeability to water, chemicals, solvents, or other concrete-corrosive materials. The section's high impermeability minimizes structural corrosion of the individual concrete section 250 and preserves the load bearing capacity of the entire concrete piling 200.

The reduction in the size and number of voids also increases the strength of the second concrete section 250, providing greater load bearing capacity with less concrete. This permits the construction and use of a tubular concrete section where a solid concrete structure would otherwise be required. By way of example, the silica-mixed concrete section 250 will have more than double the load bearing capacity and weighs approximately 40% less compared to a similarlysized solid concrete piling. In an alternative embodiment, the internal cavity 255 may be filled with standard grade or another type of concrete.

In one embodiment, silica-mixed concrete includes between 10 to 40 lbs./yd$^3$ of microsilica or 0.025 to 1% by weight to the standard concrete mix, although other concentrations of microsilica may be used in alternative embodiments. Exemplary dimensions for the second concrete section 250 may be an outer diameter of 8 feet, and inner diameter of between 6 feet, and a length of 100 feet. The actual dimensions will vary depending upon a variety of factors including the desired load capacity, properties and depth of the load bearing surface, connecting concrete sections, as well as other factors appreciable to those of skill in the art.

Within the internal cavity 255 of the second concrete section 250, a sealing joint 256 is formed between the first and second concrete sections 210 and 250. Sealing joint 256 is formed from the first concrete type, standard grade concrete in the illustrated embodiment, although in an alternative embodiment, the second concrete type (silica-mixed concrete), a third concrete type, or a non-concrete sealing material may be used.

The second concrete section 250 further includes a sealing plug 257 which is formed substantially at the top surface 258 of the second concrete section 250. The sealing plug 257 may be a plug formed from the first concrete type, the second concrete top, a third concrete type, or a non-concrete sealing material.

Figure 3:
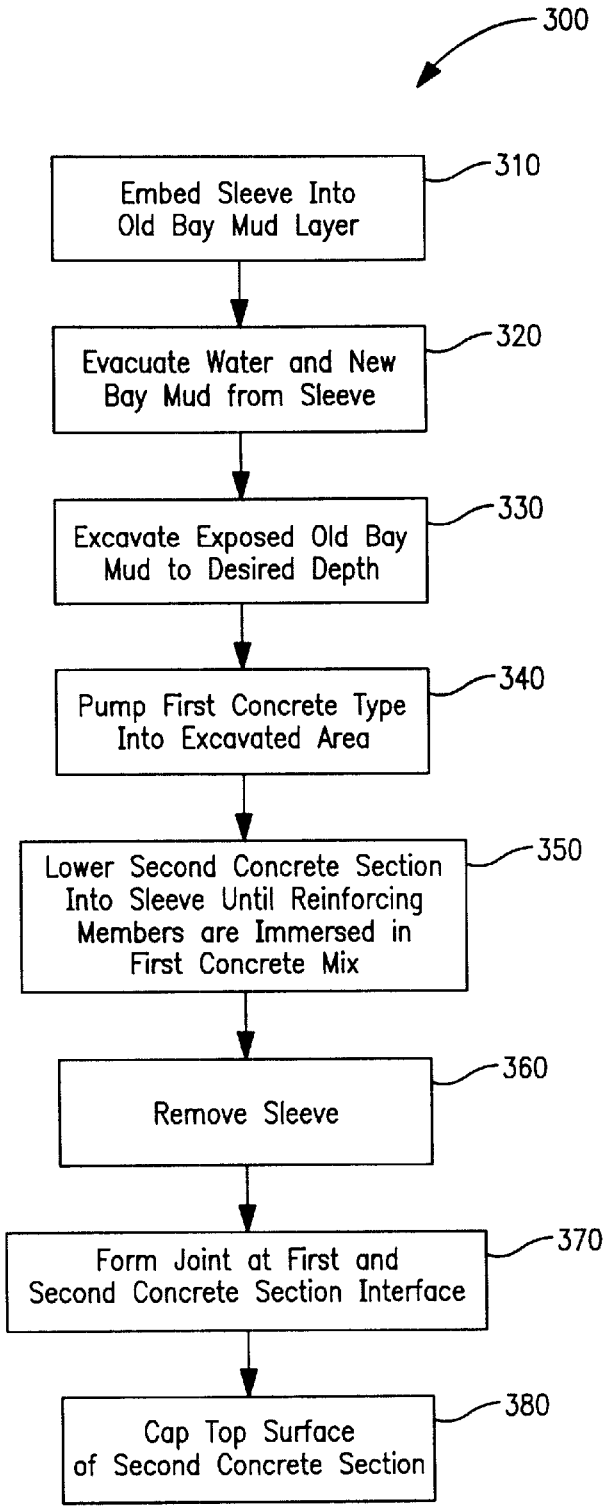
FIG. 3 illustrates a flow chart describing a method for manufacturing the multi-sectioned concrete piling shown in FIG. 2 in accordance with the present invention.

FIG. 3 illustrates a flow chart describing one method for manufacturing the multi-sectioned concrete piling 200 in accordance with the present invention and FIGS. 4A–4D illustrate the stages of the construction corresponding thereto. Initially at 310, a water-impenetrable sleeve 410 is driven into the seabed 230. The sleeve 410 may be composed on any substantially water-resistant, water-proof, or water impermeable material. In one embodiment the sleeve 410 is constructed from steel, although other water resistant materials may be used as well.

The dimensions of the sleeve 410 may also vary depending upon the application. In one embodiment, the sleeve 410 will have a height substantially equivalent to the height of the second concrete section 250, as illustrated in the process described below. Alternatively, the sleeve 410 may be longer in order to house the first concrete section 210, and/or to house additional concrete sections placed on top of the second concrete section 250 when they are implemented. The inner diameter of the sleeve 410 may vary. For instance in one embodiment, the sleeve's inner diameter and second concrete section's outer diameter provides a relatively close fit, thereby providing support to the second concrete section 250. In another embodiment, a larger separation exists between the inner diameter of the sleeve 410 and the outer diameter of the second concrete section 250. A larger separation may be used in order to provide sufficient clearance between the inner diameter of the sleeve 410 and concrete which is lower or poured into the sleeve 410. Alternatively as a cost saving measure, the user may elect to employ a single sleeve 410 having an inner diameter which is capable of accommodating the largest anticipated second concrete section 250.

The distance to which the sleeve 410 is driven into the seabed 230 is a design choice dependent upon the load, condition of the seabed 230 or other factors appreciable to those skilled in the art. In one embodiment, the sleeve 410 is driven into the seabed 230 through the new bay mud 232 to the old bay mud layer 234. In other embodiments, the sleeve 410 may extend only into the new bay mud layer 232 or alternatively may extend through the old bay mud layer 234.

At 320, the water, new bay mud and other material captured within the sleeve 410 are evacuated. As explained above, the new bay mud exists in a relatively liquid state and can thus be evacuated without much difficulty. The captured water and new bay mud may be evacuated from the sleeve using a water jet or by regular bucketing.

Figure 4A:
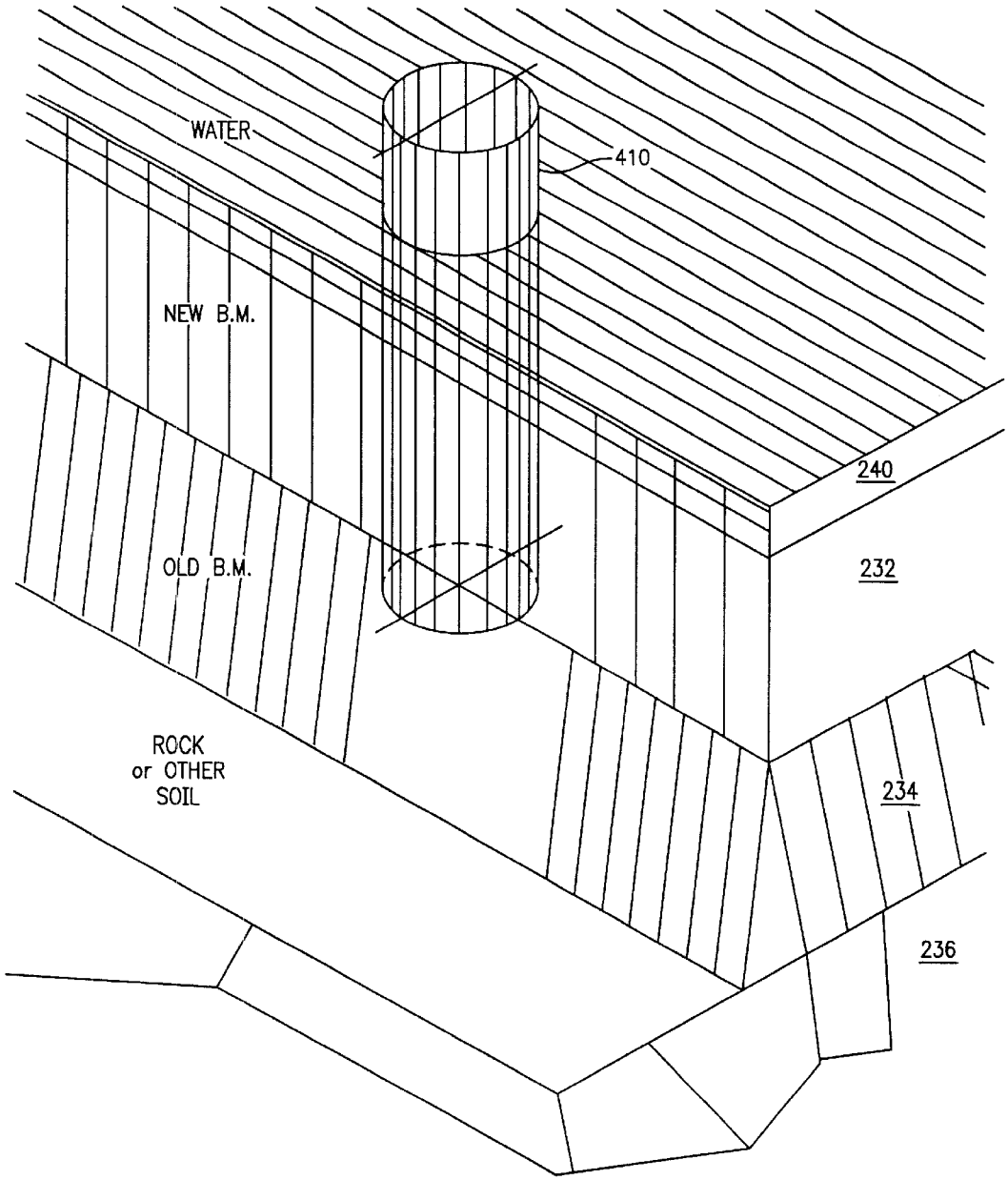
FIGS. 4A–4F illustrates the various stages of construction of a concrete piling formed in accordance with the method illustrated in FIG. 3.
Figure 4B:
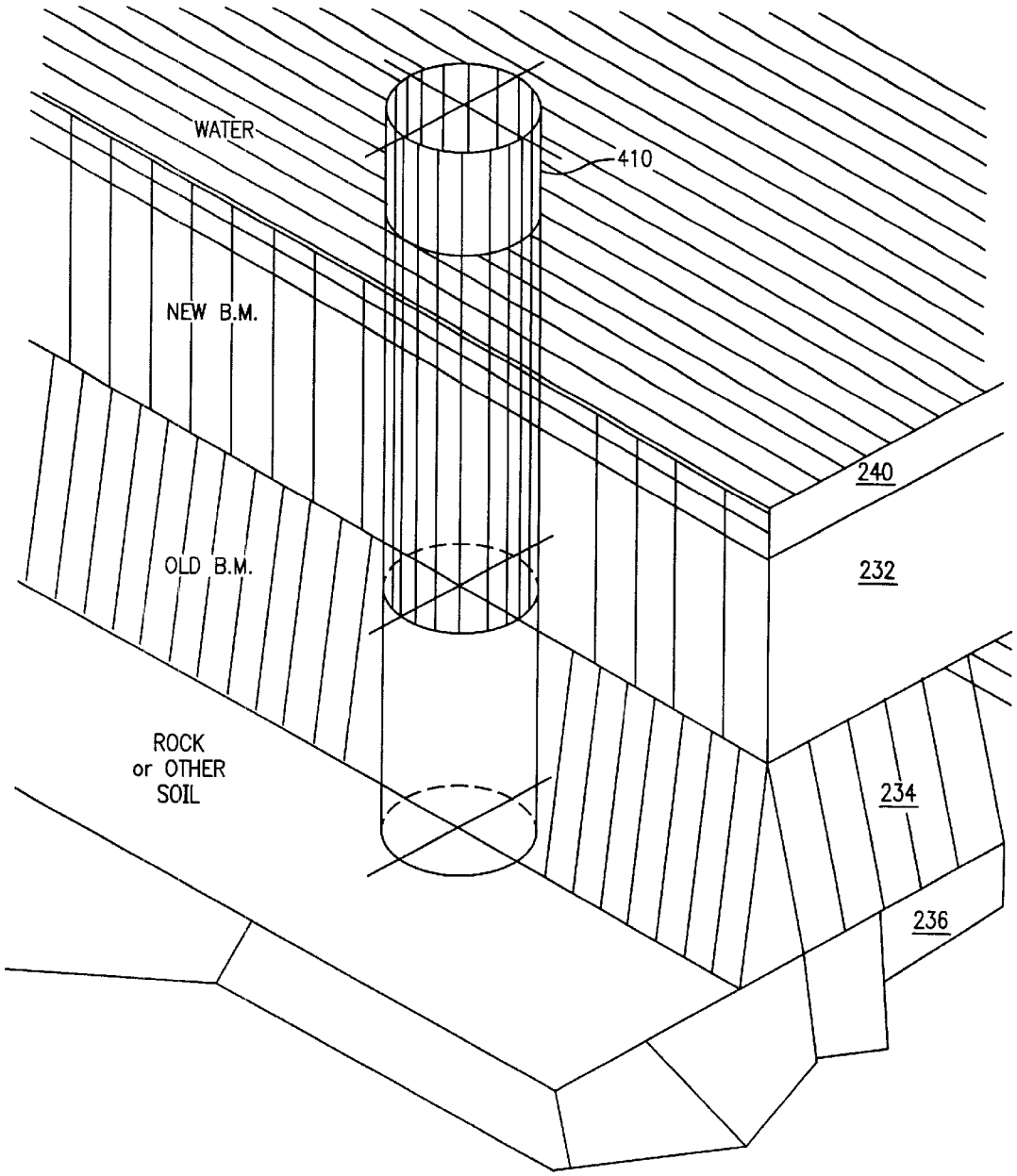

At 330, the exposed old bay mud within the sleeve is excavated to a predefined depth. A commercially-available large diameter drill may be used to perform this operation. The excavated area 412 of this stage of construction is illustrated in FIG. 4B.

Figure 4C:
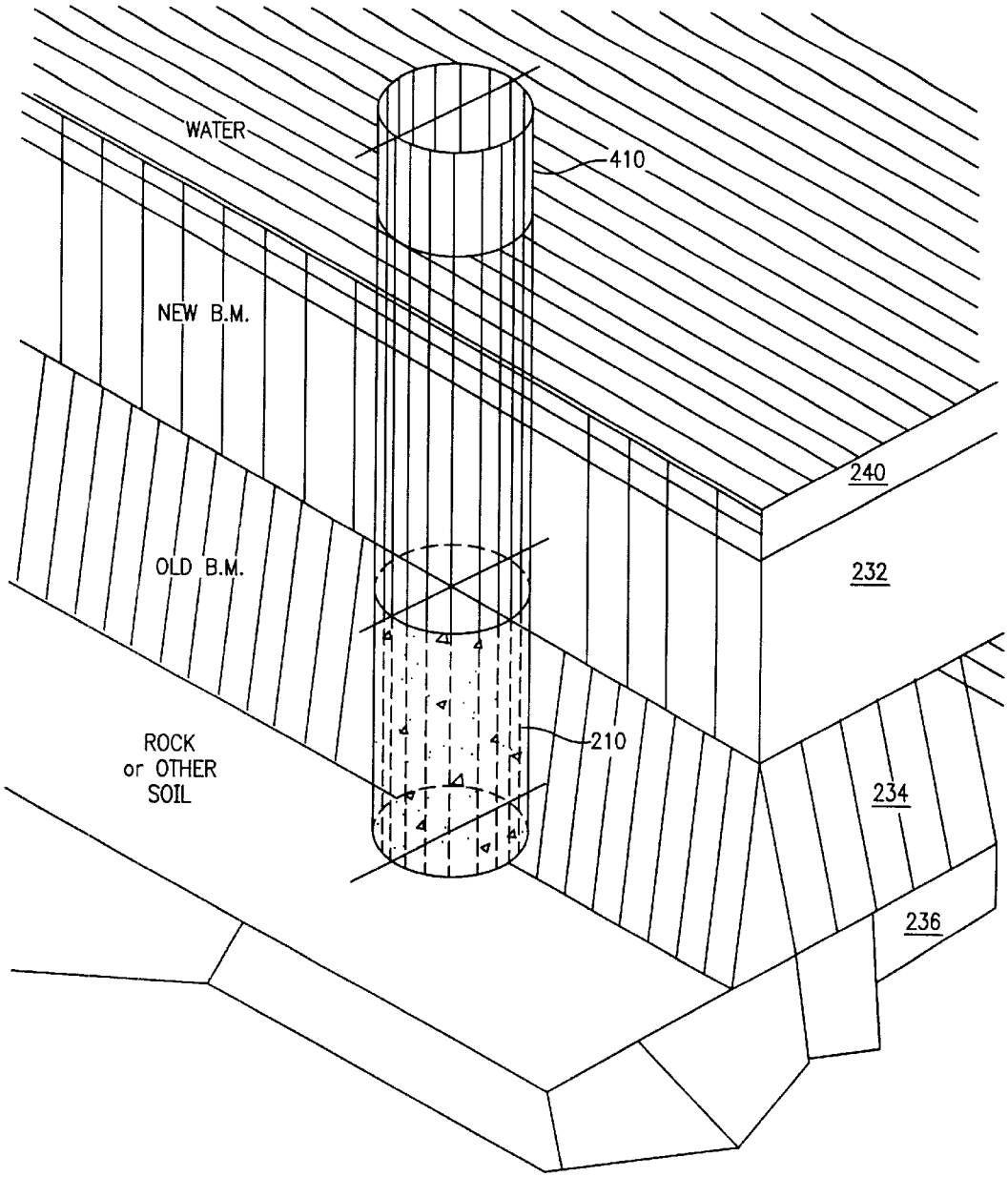

At 340, the first concrete type, standard concrete in the illustrated embodiment, is deposited into the excavated area. The dimensions of the excavated area and accordingly the first concrete section will depend upon the desired load bearing capacity, flow resistance of the old bay mud or other corresponding medium, the type of concrete mix used, as well as other factors appreciable to those of skill in the art. In one embodiment, the depth of the excavated area extends between 5 to 50 feet into the old bay mud layer and the diameter of the first concrete section is between 6 feet to 10 feet. A superplastizer may be added to the concrete mix in order to reduce the amount of water required. This stage of construction is shown in FIG. 4C.

Figure 4D:
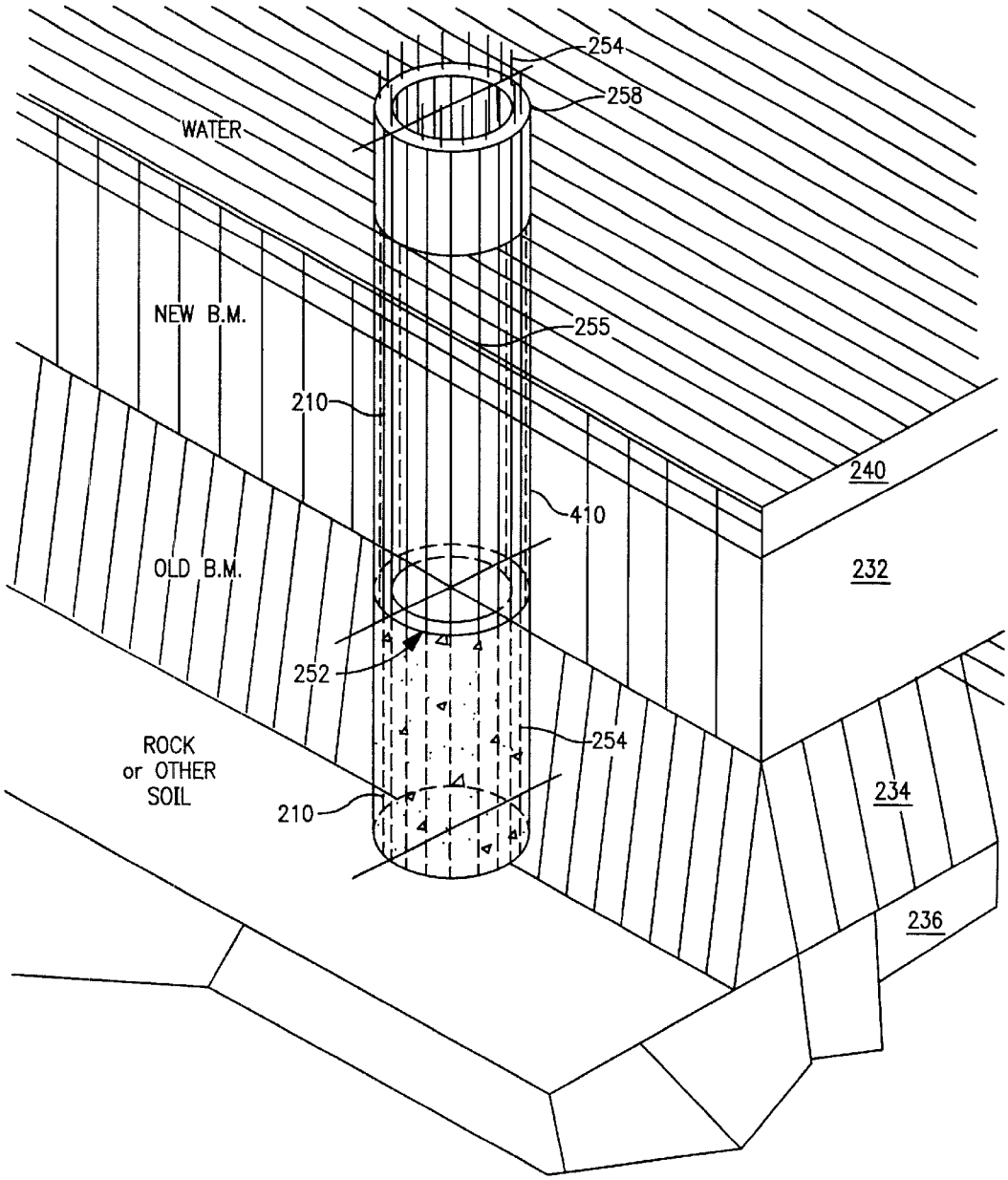

At 350, a second concrete section having a second, dissimilar concrete type (silica-mixed concrete in the illustrated embodiment) is lowered into the sleeve 410 and attached to the first concrete section 210, as shown in FIG. 4D. This process may be performed using one or more barge cranes. In the illustrated embodiment in which the first concrete section 210 is poured, process 350 occurs before the first concrete section 210 hardens to allow the reinforcing members 254 extending from the bottom surface 252 of the second concrete section 250 to immerse, at least partially, into the first concrete section 210. The first concrete section 210 is then allowed to harden, thereby establishing attachment between the first and second concrete sections 210 and 250. In an alternative embodiment, the first concrete section 210 may be pre-cast and lowered into the excavated area 412. In this embodiment, the second concrete section 250 may be poured atop of the first concrete section 210. In this embodiment, the first concrete section 210 may include reinforcing members (not shown) which extend vertically upwards to provide attachment reinforcement with the second concrete section 250. Those of skill in the art that other variations of the foregoing description are also possible and within the scope of the present invention.

Figure 4E:
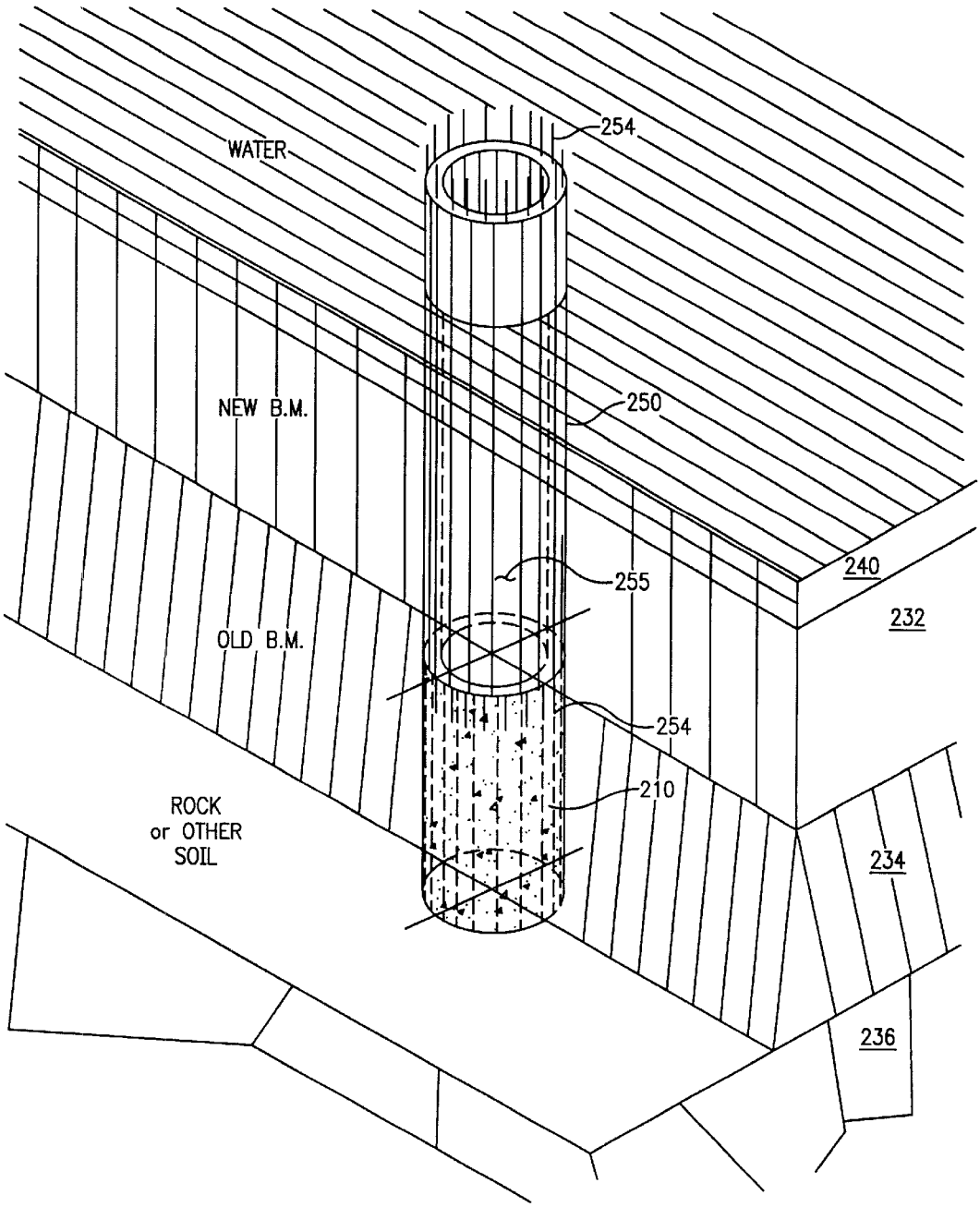

At 360, the water-impenetrable sleeve 410 is removed. As described above, the second concrete section 250 is sufficiently water-impermeable, preventing water from penetrating its outer surface or its internal cavity area 255. This stage of construction is shown in FIG. 4E.

At 370, a joint 256 between the first and second concrete sections 210 and 250 is formed by applying, via the internal cavity 255, concrete or another sealing material at the interface of the first and second concrete sections 210 and 250. In one embodiment, the joint 256 is formed from standard concrete and extends between ½–5 feet in height above the first/second concrete section interface.

Figure 4F:
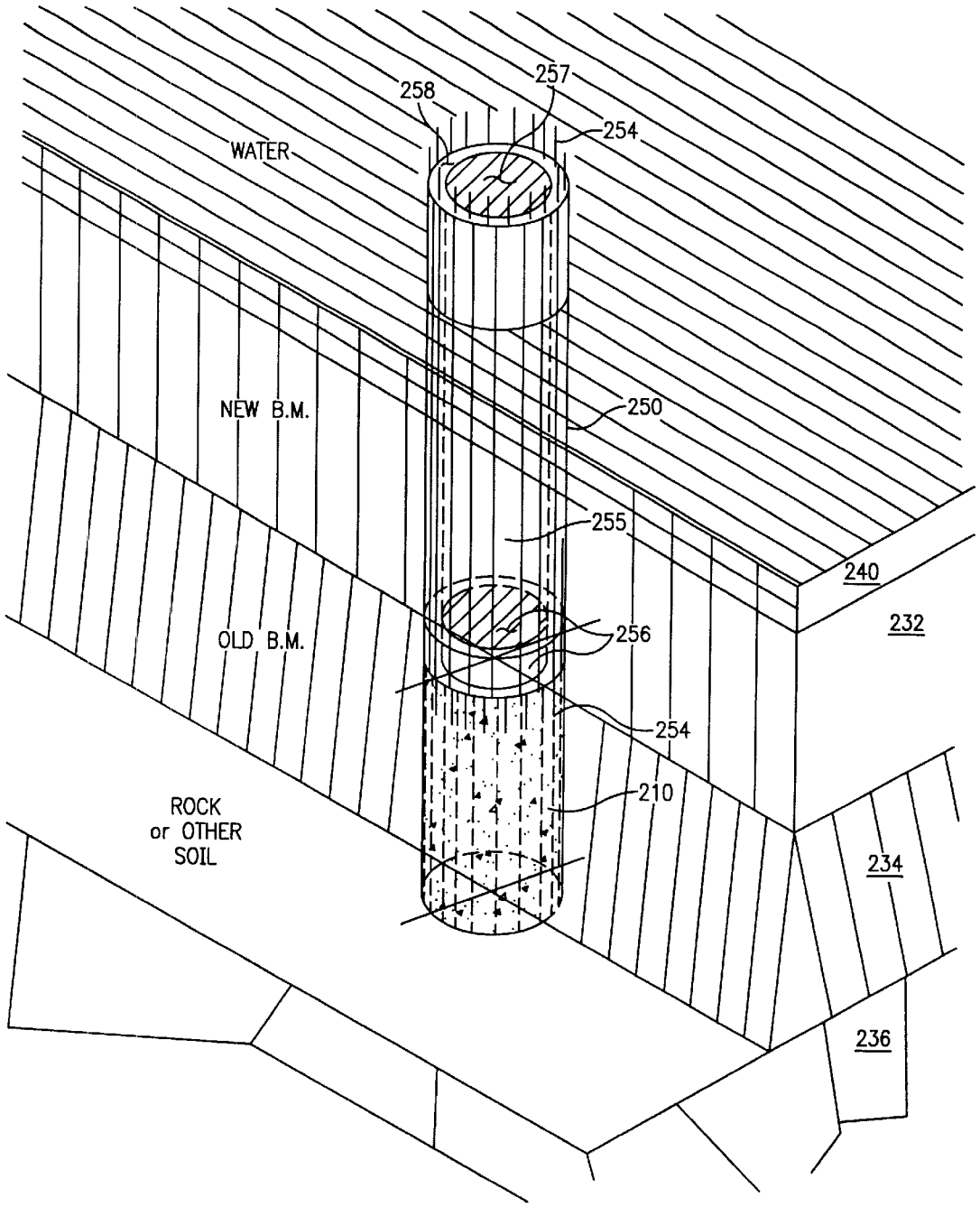

At 380, the opening of the top surface 258 of the second concrete section 250 is capped using a plug 257. The plug 257 may be formed from concrete or another type of sealing material. In one embodiment, process 380 may be performed by initially positioning a support structure into the cavity 255 a predefined depth below the top surface 258. Support structure may be suspended within the cavity 255 by wires which are anchored on the exterior of the second concrete section 250, for instance on the top surface 258. Plug 257 is subsequently formed by depositing, via the top surface 258, concrete or another sealing material onto the internally-disposed support structure. In one embodiment, the support structure is located between ½ to 5 feet below the top surface 258 of the second concrete section 250 and the sealing material is formed from standard concrete. The construction of the complete concrete piling is shown in FIG. 4F.

The present invention has now been described in terms of one exemplary embodiment, a multi-sectioned concrete piling having improved strength and corrosion resistance. The invention is not limited to the illustrated embodiment. Indeed, other equivalents, modifications, and alterations of the invention are possible based upon the foregoing description. For instance, a vertically or horizontally oriented multi-section concrete support beam may also be constructed using the materials, systems, and methods provided herein.

Accordingly, the scope of the invention is defined by the metes and bounds of the following claims:

1. A multi-sectioned concrete support structure, comprising:

a first concrete section comprising a first concrete type, the first concrete section having a first surface attached to a load bearing surface and a second surface; and a second concrete section comprising a second concrete type, the second concrete section having a first surface attached to the second surface of the first concrete section and a second surface coupled to the load, wherein an internal cavity is formed along the center load line between the first and second surfaces of the second concrete section, and wherein the internal cavity is filled at least partially with a third concrete type.

2. The multi-sectioned concrete structure of claim 1, wherein the first concrete type comprises standard grade concrete.

3. The multi-sectioned concrete structure of claim 1, wherein the second concrete type comprises silica-mixed concrete.

4. The multi-sectioned concrete structure of claim 3, wherein the first and third concrete types each comprise standard grade concrete.

5. The multi-sectioned concrete structure of claim 4, wherein the load bearing surface comprises a seabed.

6. A method for manufacturing a multi-sectioned concrete support structure, the method comprising:

providing a first concrete section comprising a first concrete type;

providing a second concrete section comprising a second concrete type, wherein the second concrete section includes an internal cavity extending along the center load line of the second concrete section;

attaching the first concrete section to the second concrete section; and filling, at least partially, the internal cavity of the second concrete section with a third concrete type.

7. The method of claim 6, wherein the first concrete type comprises standard grade concrete.

8. The method of claim 7, wherein the second concrete type comprises silica-mixed concrete.

9. The method of claim 8, wherein the third concrete type comprise standard grade concrete.

10. The method of claim 9, wherein the process of providing a first concrete section further comprises:

embedding a water-impermeable sleeve into a load bearing surface; and excavating, to a predefined depth, the area contained within the sleeve.

11. The method of claim 10, wherein providing a first concrete section comprises pouring concrete into the excavated area.

12. The method of claim 10, wherein providing a first concrete section comprises lowering a concrete portion through the water-impermeable sleeve into the excavated area.

13. The method of claim 10, wherein providing a second concrete section comprises lowering, through the water-impermeable sleeve, a pre-cast concrete section on top of the first concrete section.

14. The method of claim 13, wherein the outer dimension of the pre-cast concrete section closely approximates the inner dimension of the water-impermeable sleeve.

15. The method of claim 13 wherein the outer dimension of the pre-cast section is substantially less than the inner dimension of the water-impermeable sleeve.

16. The method of claim 10, wherein providing a second concrete section comprises pouring, through the water-impermeable sleeve, silica-mixed concrete on top of the first concrete section.

17. The method of claim 10, wherein the load bearing surface comprises a seabed having a new bay mud layer, an old bay mud layer, and a bed rock layer, wherein embedding a water-impermeable sleeve into a load bearing surface comprises embedding the water-impermeable sleeve into the new bay mud layer of the seabed.

18. The method of claim 10, wherein the load bearing surface comprises a seabed having a new bay mud layer, an old bay mud layer, and a bed rock layer, wherein embedding a water-impermeable sleeve into a load bearing surface comprises embedding the water-impermeable sleeve into the old bay mud layer of the seabed.

19. The method of claim 10, wherein the load bearing surface comprises a seabed having a new bay mud layer, an old bay mud layer, and a bed rock layer, wherein embedding a water-impermeable sleeve into a load bearing surface comprises embedding the water-impermeable sleeve into the bedrock layer of the seabed.

20. A system for manufacturing a multi-sectioned concrete support structure, the method comprising:

means for providing a first concrete section comprising a first concrete type;

means for providing a second concrete section comprising a second concrete type, wherein the second concrete section includes an internal cavity extending along the center load line of the second concrete section;

means for attaching the first concrete section to the second concrete section; and means for filling, at least partially, the internal cavity of the second concrete section with a third concrete type.

* * * * *